US011462355B2

(12) United States Patent
Yoshikawa et al.

(10) Patent No.: US 11,462,355 B2
(45) Date of Patent: Oct. 4, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kohei Yoshikawa, Mie (JP); Takashi Misaki, Mie (JP); Shinichiro Yamamoto, Mie (JP); Hajime Kawaguchi, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 446 days.

(21) Appl. No.: 16/620,689

(22) PCT Filed: Jul. 4, 2018

(86) PCT No.: PCT/JP2018/025421
§ 371 (c)(1),
(2) Date: Dec. 9, 2019

(87) PCT Pub. No.: WO2019/013075
PCT Pub. Date: Jan. 17, 2019

(65) Prior Publication Data

US 2020/0126716 A1 Apr. 23, 2020

(30) Foreign Application Priority Data

Jul. 12, 2017 (JP) ..... JP2017-136573

(51) Int. Cl.
*H01F 27/40* (2006.01)
*H01F 27/24* (2006.01)
(Continued)

(52) U.S. Cl.
CPC ..... *H01F 27/402* (2013.01); *H01F 27/24* (2013.01); *H01F 27/2823* (2013.01); *H01F 27/29* (2013.01)

(58) Field of Classification Search
CPC .... H01F 27/402; H01F 27/24; H01F 27/2823; H01F 27/29
See application file for complete search history.

(56) References Cited

U.S. PATENT DOCUMENTS 8,860,542 B2 * 10/2014 Yoshikawa ..... H01F 27/02 336/192
2005/0148213 A1 * 7/2005 Takase ..... B60R 16/0215 439/34

(Continued)

FOREIGN PATENT DOCUMENTS

JP S58-040808 U 3/1983
JP 2013-222813 A 10/2013

OTHER PUBLICATIONS

International Search Report, Application No. PCT/JP2018/025421, dated Sep. 25, 2018. ISA/Japan Patent Office.

*Primary Examiner* — Michael P McFadden
(74) *Attorney, Agent, or Firm* — Honigman LLP

(57) ABSTRACT

Provided is a reactor including a coil and a magnetic core that includes inner core portions arranged inside of a wound portions and outer core portions arranged outside of the wound portions. A sensor measures a physical amount that is related to a combined body of the coil and the magnetic core. A wiring locking portion locks a wiring of the sensor. The wiring locking portion includes a first claw member and a second claw member. A wiring path is formed inside a bent portion of the claw members. The second claw member is spaced apart from the first claw member a distance L between the leading end of the first claw member and the leading end of the second claw member in the Y direction is (Continued)

greater than 1 times the diameter of the wiring and less than or equal to 1.5 times the diameter of the wiring.

16 Claims, 5 Drawing Sheets

(51) Int. Cl.
*H01F 27/28* (2006.01)
*H01F 27/29* (2006.01)

(56) References Cited

U.S. PATENT DOCUMENTS

| | | | | |
|---|---|---|---|---|
| 2012/0092120 | A1* | 4/2012 | Yoshikawa | H01F 27/327<br>336/221 |
| 2013/0222100 | A1* | 8/2013 | Nomura | H01F 27/025<br>336/55 |
| 2014/0085026 | A1* | 3/2014 | Yamada | H01F 27/402<br>336/90 |
| 2014/0133204 | A1 | 5/2014 | Yoshikawa | |
| 2017/0184457 | A1* | 6/2017 | Maeno | H01F 27/02 |
| 2018/0261370 | A1* | 9/2018 | Hirabayashi | H01F 27/24 |

* cited by examiner

REACTOR

CROSS-REFERENCE TO RELATED APPLICATIONS

This application is the U.S. national stage of PCT/JP2018/025421 filed on Jul. 4, 2018, which claims priority of Japanese Patent Application No. JP 2017-136573 filed on Jul. 12, 2017, the contents of which are incorporated herein.

TECHNICAL FIELD

The present disclosure relates to a reactor.

BACKGROUND

A reactor is one component of a circuit that performs a voltage boost operation and a voltage lowering operation. For example, JP 2013-128084A discloses a reactor including: a coil having wound portions formed by winding winding wires; and a ring-shaped magnetic core that includes inner core portions arranged inside of the wound portions, and outer core portions arranged outside of the wound portions. Normally, power is supplied to the coil from an external device such as a power source via external wiring (a lead wire, bus bar, etc.).

The reactor disclosed in JP 2013-128084A further includes a sensor for measuring a physical amount (e.g., temperature, acceleration) that is related to a combined body and that changes in accordance with energization of the coil, and a wiring hooking portion (wiring locking portion) for locking a wiring of the sensor.

With recent improvements in electric vehicles, operation frequencies of reactors tend to be high, and vibration in reactors tends to be more intense. For this reason, a conventional wiring locking portion cannot sufficiently hold a wiring of a sensor, and the wiring may come loose from the wiring locking portion. If the wiring comes loose and moves intensely along with vibration in the reactor, there is also a possibility that disconnection will occur at a joint between a sensor element and the wiring or the like.

SUMMARY

A reactor according to the present disclosure includes a coil that has wound portions formed by winding a winding wire and a magnetic core that includes inner core portions arranged inside of the wound portions and outer core portions arranged outside of the wound portions. A sensor is configured to measure a physical amount that is related to a combined body of the coil and the magnetic core and that changes in accordance with energization of the coil. A wiring locking portion is configured to lock a wiring of the sensor, and the wiring locking portion includes a first claw member that is provided in a standing manner on a flat surface portion of any member included in the reactor and that is bent at a leading end side thereof. A second claw member is provided in a standing manner on the flat surface portion and is bent at a leading end side thereof, in a direction that is opposite to the direction in which the first claw member is bent. A wiring path is formed inside the bent portions of the claw members, and in which the wiring is arranged, and when, among directions along the flat surface portion, a direction along the direction in which the first claw member is bent is denoted as an X direction, a direction perpendicular to the X direction is denoted as a Y direction, and a vertical direction with respect to the flat surface portion is denoted as a Z direction, the second claw member is provided at a position spaced apart from the first claw member in the X direction and the Y direction, a separation distance L between the leading end of the first claw member and the leading end of the second claw member in the Y direction is greater than 1 times the diameter of the wiring and less than or equal to 1.5 times the diameter of the wiring, and when the wiring that is locked in the wiring locking portion is viewed in the Z direction, the sum of an overlap length of a portion of the first claw member that overlaps an upper portion of the wiring and an overlap length of a portion of the second claw member that overlaps an upper portion of the wiring is greater than or equal to the diameter of the wiring.

Advantageous Effects

In view of this, the present disclosure provides a reactor that includes a wiring locking portion into which a wiring can be easily fitted, and from which the wiring is unlikely to come loose even if the reactor vibrates intensely.

DETAILED DESCRIPTION OF PREFERRED EMBODIMENTS

Figure 1:
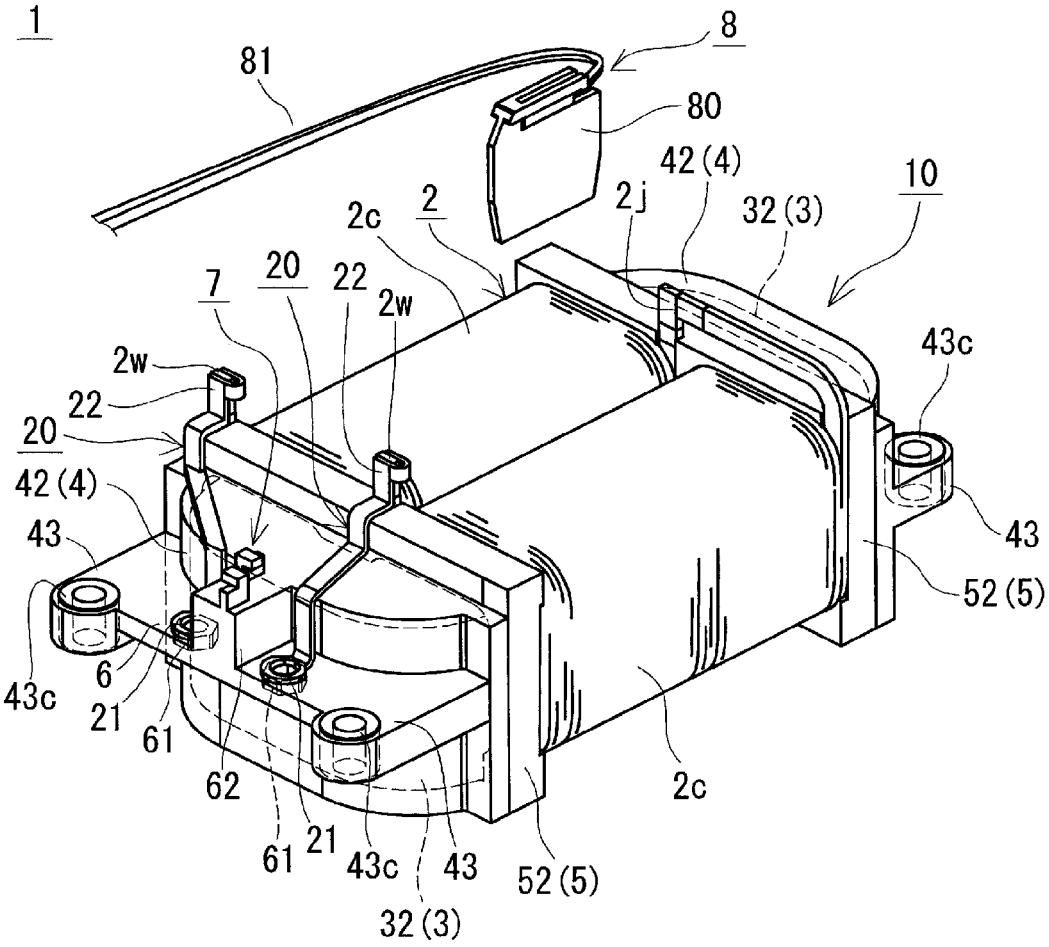
FIG. 1 is a schematic perspective view of a reactor according to Embodiment 1.

First, embodiments of the present disclosure will be listed and illustrated.

A reactor according to an embodiment includes a coil that has wound portions formed by winding a winding wire and a magnetic core that includes inner core portions arranged inside of the wound portions and outer core portions arranged outside of the wound portions. A sensor is configured to measure a physical amount that is related to a combined body of the coil and the magnetic core and that changes in accordance with energization of the coil. A wiring locking portion is configured to lock a wiring of the sensor, and the wiring locking portion includes a first claw member that is provided in a standing manner on a flat surface portion of any member included in the reactor and that is bent at a leading end side thereof. A second claw member is provided in a standing manner on the flat surface portion and is bent at a leading end side thereof, in a direction that is opposite to the direction in which the first claw member is bent. A wiring path is formed inside the bent portions of the claw members, and in which the wiring is arranged, and when, among directions along the flat surface portion, a direction along the direction in which the first claw member is bent is denoted as an X direction, a direction perpendicular to the X direction is denoted as a Y direction, and a vertical direction with respect to the flat surface portion is denoted as a Z direction, the second claw member is provided at a position spaced apart from the first claw member in the X direction and the Y direction, a separation distance L between the leading end of the first claw member and the leading end of the second claw member in the Y direction is greater than 1 times the diameter of the wiring and less than or equal to 1.5 times the diameter of the wiring, and when the wiring that is locked in the wiring locking portion is viewed in the Z direction, the sum of an overlap length of a portion of the first claw member that overlaps an upper portion of the wiring and an overlap length of a portion of the second claw member that overlaps an upper portion of the wiring is greater than or equal to the diameter of the wiring.

According to the above-described configuration of the reactor, the wiring of the sensor is unlikely to come loose from the wiring locking portion even if the reactor vibrates intensely. This is because when the first claw member and the second claw member of the wiring locking portion that are arranged so as to sandwich the wiring from the two sides are viewed from above (in the Z direction), the sum of overlap lengths of the claw members with respect to the wiring is greater than or equal to the diameter of the wiring. With this configuration, even if the wiring shifts in the left-right direction (X direction), the wiring is very unlikely to comes out of place in the Z direction.

Usually, with a configuration in which a wiring is not likely to come loose, it is often difficult to fit the wiring in many cases. However, it is not true of the wiring locking portion according to this example. This is because the first claw member and the second claw member are spaced apart from each other in the Y direction by a distance greater than or equal to the diameter of the wiring. When fitting the wiring into the claw members, the wiring is fitted into a separation space between the claw members in the Y direction. The portion of the wiring that is fitted into the separation space substantially extends along the X direction. Thereafter, the wiring can be easily fitted into the claw members by pulling both ends of the wiring, rotating the portion fitted into the separation space, or the like, so as to stretch the portion straight in the Y direction. Here, the longer the separation distance between the claw members is, the more easily the wiring is fitted into the separation space between the claw members, but the more likely the wiring is to come loose from the claw members. In view of this, in order to make it easy for the wiring to be fitted into the separation space and make it difficult for the wiring to come loose from the claw members, the separation distance is made less than or equal to 1.5 times the diameter of the wiring.

[In one aspect of the reactor according to an embodiment, a configuration is also possible in which the overlap length t1 of the first claw member and the overlap length t2 of the second claw member are greater than or equal to the radius of the wiring and less than or equal to the diameter of the wiring.

When the cross-section of the wiring is circular, if the overlap lengths of the claw members are short, the portions of the claw members that cover the upper portion of the wiring will not be in contact with the wiring. In contrast to this, if the overlap lengths t1 and t2 of the claw members are greater than or equal to the radius of the wiring, the portions of the claw members that cover the upper portion of the wiring will reliably be in contact with the wiring, and thus shifting of the wiring can be easily suppressed.

In one aspect of the reactor according to an embodiment, a configuration is also possible in which the first claw member includes a first base portion that extends in the Z direction and a first bent end that extends from the leading end of the first base portion toward the second claw member in the X direction, and the second claw member includes a second base portion that extends in the Z direction and a second bent end that extends from the leading end of the second base portion toward the first claw member in the X direction.

As shown in the above-described configuration, the approximately L-shaped configurations of the claw members that include the base portions and the bent ends that extend from and are perpendicular to the leading ends of the base portions can be easily formed. In addition, the base portions that extend straight in the Z direction effectively suppress movement of the wiring in the X direction, and the bent ends that extend straight in the X direction effectively suppress movement of the wiring in the Z direction. As a result, the wiring is very unlikely to come loose from the claw members.

In one aspect of the reactor according to (3) above, a configuration is also possible in which the first claw member includes a first guide wall that extends from a side portion of the first base portion, in a direction away from the second claw member in the Y direction, and the second claw member includes a second guide wall that extends from a side portion of the second base portion, in a direction away from the first claw member in the Y direction.

If the guide walls are provided on the claw members, it is easy to regulate the direction of the wiring that is fitted into the claw members. For example, it is possible to guide the wiring in the desired direction by bending a far end (end portion located away from the base portion) of the guide wall.

In one aspect of the reactor according to an embodiment, a configuration is also possible in which the reactor further includes a plurality of the wiring locking portions, and the wiring path of one of the wiring locking portions and the wiring path of another of the wiring locking portions are non-coaxial to each other.

If a plurality of the wiring locking portions are provided, the wiring can be locked more reliably. In addition, if the wiring paths of the wiring locking portions are non-coaxial to each other, the wiring can be guided in the desired direction. For example, if the wiring path of a second wiring locking portion is perpendicular to the wiring path of a first wiring locking portion, it is possible to bend the wiring at a right angle.

In one aspect of the reactor according to an embodiment, a configuration is also possible in which the reactor further includes terminal fittings that are connected to end portions of the winding wire; a bridge member that electrically connects the terminal fittings to an external wiring; and a terminal platform that serves as a platform for fastening the terminal fittings to the bridge member, and the wiring locking portion is formed on the terminal platform.

Since the terminal platform is relatively large and it is easy to ensure a flat surface portion that is large enough to include the wiring locking portion, the terminal platform is suitable for forming the wiring locking portion.

In one aspect of the reactor according to an embodiment, the reactor including terminal fittings, a bridge member, and the terminal platform, a configuration is also possible in which the wiring locking portion is formed on the bridge member.

Since the bridge member is also relatively large and it is easy to ensure a flat surface portion that is large enough to include the wiring locking portion, the bridge member is suitable for forming the wiring locking portion.

In one aspect of the reactor according to an embodiment, the reactor including the terminal fitting, the bridge member, and the terminal platform, a configuration is also possible in which the reactor further includes: an outer resin portion that covers at least an outer surface of the outer core portions, and the terminal platform is formed by a portion of the outer resin portion.

The outer core portions can be thus protected by the outer resin portions. Moreover, if the terminal platform is formed in one piece with an outer resin portion, an increase in the number of parts can be suppressed.

Specific examples of a reactor according to an embodiment of the present disclosure will be described hereinafter with reference to the drawings. Objects with identical names are denoted as identical reference numerals in the drawings. Note that the present invention is not limited to these illustrations, but rather is indicated by the claims. All modifications within the meaning and range of equivalency to the claims are intended to be encompassed therein.

Embodiment 1

Overall Configuration of Reactor

A reactor 1 according to Embodiment 1 will be described with reference to FIGS. 1 to 6. As shown in FIG. 1, the reactor 1 of Embodiment 1 includes a combined body 10 obtained by combining a coil 2 that has wound portions 2*c*, and a magnetic core 3 arranged inside and outside of the wound portions 2*c*. This combined body 10 further includes an insulating interposed member 5 that secures insulation between the coil 2 and the magnetic core 3, a molded resin portion 4 that integrates the coil 2 and the magnetic core 3, and the like. The reactor 1 in this example further includes a sensor 8 for measuring a physical amount that is related to the combined body 10 and that changes in accordance with energization of the coil 2, and a wiring locking portion 7 (see the vicinity of a terminal platform 6 at the bottom-left in the drawing) that locks a wiring 81 of the sensor 8. One of the characteristics of the reactor 1 according to this example may be the configuration of the wiring locking portion 7. Hereinafter, prior to the description of the wiring locking portion 7, the configuration of the reactor 1 excluding the wiring locking portion 7 will be described, and thereafter, the wiring locking portion 7 will be described in detail.

Coil

The coil 2 has two wound portions 2*c*, and the two wound portions 2*c* are arranged side by side. The coil 2 in this example has two wound portions 2*c* formed by winding two winding wires 2*w* in a spiral shape, and the end portions on one side of the winding wires 2*w* that form the two wound portions 2*c* are connected via a bonding portion 2*j*. The two wound portions 2*c* are arranged side by side (in parallel) such that their axial directions are parallel to each other. The bonding portion 2*j* is formed by bonding the end portions on one side of the winding wires 2*w* pulled out from the wound portions 2*c* using a bonding method such as welding, soldering, or brazing. The end portions on the other side of the winding wires 2*w* are pulled out in a suitable direction (in this example, upward) from the wound portions 2*c*. Terminal fittings 20 are respectively attached to the other end portions of the winding wires 2*w* (that is, both ends of the coil 2), and are electrically connected to an external device such as a power source (not shown) via a later-described bridge member 9 (see FIG. 6). A known coil can be used as the coil 2, and for example, the two wound portions 2*c* may be formed with one continuous winding wire.

The shape, size, winding direction, and number of turns of the two wound portions 2*c* may be the same or different (in this example, the wound portions 2*c* have the same specification). In this example, the adjacent turns that form the wound portions 2*c* are in close contact with each other. For example, the winding wires 2*w* are covered wires (so-called enamel wires) that include a conductor (copper, etc.) and an insulating covering (polyamide imide, etc.) on the outer periphery of the conductor. In this case, the wound portions 2*c* are quadrangular tube-shaped (specifically, rectangular tube-shaped) edgewise coils obtained by winding the winding wires 2*w*, which are covered flat wires, in an edgewise manner, and the shape of the end surface of a wound portion 2*c* viewed in the axial direction is a rectangular shape with rounded corner portions. The shape of the wound portion 2*c* is not particularly limited, and for example, may also be circular tube-shaped, ovoid tube-shaped, elliptical tube-shaped (racetrack-shaped), or the like. The specifications of the winding wires 2*w* and the wound portions 2*c* can be changed as appropriate.

In this example, the coil 2 (wound portions 2*c*) is not covered by a later-described molded resin portion 4, and when the reactor 1 is formed, the outer peripheral surface of the coil 2 is exposed as shown in FIG. 1. For this reason, heat is easily dissipated from the coil 2 to the outside, and the heat dissipating property of the coil 2 can be improved. Of course, the coil 2 may be a molded coil formed using resin having an electrical insulation property. In addition, the coil 2 may be a thermally welded coil in which a welding layer is included between adjacent turns forming the wound portions 2*c* and the adjacent turns are thermally welded.

Magnetic Core

The magnetic core 3 includes two inner core portions 31 (see FIG. 2) that are arranged inside of the wound portions 2*c* and two outer core portions 32 that are arranged outside of the wound portions 2*c* and connect the terminals of the two inner core portions 31.

The inner core portions 31 are located inside of the wound portions 2*c* and arranged side by side (in parallel), similarly to the wound portions 2*c*. Portions of the end portions in the axial direction of the inner core portions 31 may protrude from the wound portions 2*c*.

The outer core portions 32 are portions of the magnetic core 3 that are located outside of the wound portions 2*c* and on which the coil 2 is substantially not arranged (i.e., the outer core portions 32 protrude (are exposed) from the wound portions 2*c*). The outer core portions 32 are provided so as to connect the end portions of the two inner core portions 31. In this example, the ring-shaped magnetic core 3 is formed by the outer core portions 32 being arranged so as to sandwich the inner core portions 31 from the two ends and the end surfaces of the two inner core portions 31 being connected to inner surfaces 32*i* of the outer core portions 32. Magnetic flux flows in the magnetic core 3 when current is applied to the coil 2 causing magnetization, and thus a closed magnetic path is formed.

Inner Core Portions

Figure 2:
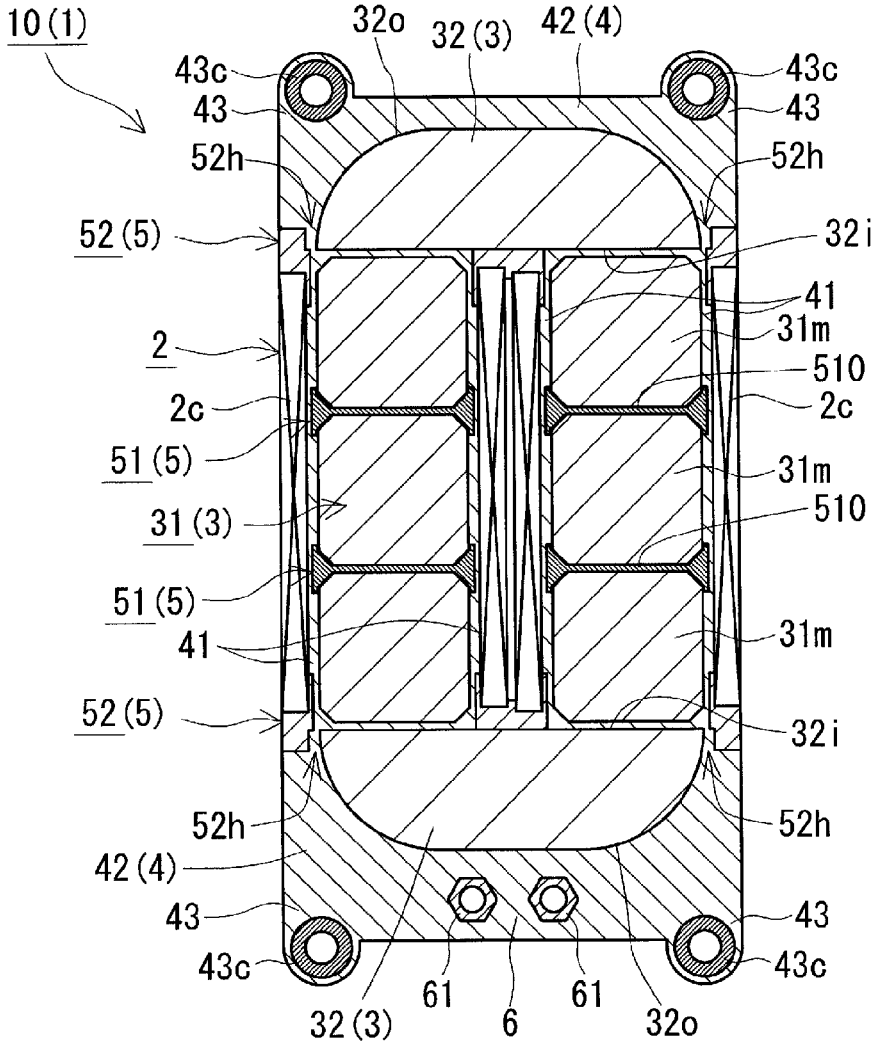
FIG. 2 is a horizontal cross-sectional view of the reactor according to Embodiment 1.

The inner core portions 31 are formed so as to correspond to the inner peripheral surfaces of the wound portions 2*c*. In this example, the inner core portions 31 are formed into quadrangular column shapes (rectangular column shapes), and the end surface shape of the inner core portions 31 viewed in the axial direction is a rectangular shape with chamfered corner portions. Also, in this example, as shown in FIG. 2, the inner core portion 31 has multiple inner core pieces 31*m*, and the inner core portion 31 is formed by joining the inner core pieces 31*m* in the length direction.

The inner core portion 31 (inner core pieces 31*m*) is made of a material that contains a soft magnetic material. The inner core pieces 31*m* are made of pressed powder molded bodies obtained by press-molding a soft magnetic powder such as iron or an iron alloy (Fe—Si alloy, Fe—Si—Al alloy, Fe—Ni alloy, etc.), a coated soft magnetic powder further including an insulating coating, or the like, a molded body of a composite material including a soft magnetic powder and a resin, or the like. A thermosetting resin, a thermoplastic resin, a room-temperature curable resin, a low-temperature curable resin, or the like can be used as the resin of the composite material. Examples of the thermosetting resin include unsaturated polyester resin, epoxy resin, urethane resin, and silicone resin. Examples of the thermoplastic resin include polyphenylene sulfide (PPS) resin, polytetrafluoroethylene (PTFE) resin, liquid-crystal polymer (LCP), polyamide (PA) resin such as nylon 6 and nylon 66, polyimide (PI) resin, polyethylene terephthalate (PBT) resin, and acrylonitrile butadiene styrene (ABS) resin. In addition, it is also possible to use: a BMC (bulk molding compound), which is obtained by mixing calcium carbonate and glass fibers into unsaturated polyester; a millable silicone rubber; a millable urethane rubber; or the like. In this example, the inner core pieces 31*m* are made of pressed powder molded bodies.

As shown in FIG. 1, the outer core portions 32 are columnar members whose upper surfaces are substantially trapezoid-shaped, and are each formed by one core piece. Similarly to the inner core pieces 31*m*, the outer core portions 32 are made of a material containing a soft magnetic material, and the above-described pressed powder molded bodies, molded bodies of a composite material, or the like can be used thereas. In this example, the outer core portions 32 are made of pressed powder molded bodies.

Insulating Interposed Member

The insulating interposed member 5 is a member that is interposed between the coil 2 (wound portions 2*c*) and the magnetic core 3 (inner core portions 31 and outer core portions 32) and ensures electrical insulation between the coil 2 and the magnetic core 3, and includes inner interposed members 51 and end surface interposed members 52. The insulating interposed member 5 (the inner interposed members 51 and the end surface interposed members 52) are made of resin having an electrical insulating property, and for example, may be made of a resin such as epoxy resin, unsaturated polyester resin, urethane resin, silicone resin, PPS resin, PTFE resin, LCP, PA resin, PI resin, PBT resin, or ABS resin.

As shown in FIG. 2, the inner interposed members 51 are interposed between the inner peripheral surfaces of the wound portions 2*c* and the outer peripheral surfaces of the inner core portions 31, and ensure electrical insulation between the wound portions 2*c* and the inner core portions 31. In this example, the inner interposed members 51 are tubular members having stopping portions 510 inside, and are configured such that the inner core pieces 31*m* can be fitted into the inner interposed members 51 from both sides. The stopping portions 510 hold the gaps between the inner core pieces 31*m* and function also as gap members.

The end surface interposed members 52 are interposed between the end surfaces of the wound portions 2*c* and the inner surfaces 32*i* (FIG. 2) of the outer core portions 32, and thus electrical insulation between the wound portions 2*c* and the outer core portions 32 is ensured. The end surface interposed members 52 are rectangular frame-shaped members that are arranged at both ends of the wound portions 2*c*. In this example, when the coil 2, the magnetic core 3, and the insulating interposed member 5 are combined with each other, and the end surface interposed members 52 are viewed from the outer surfaces 32*o* side of the outer core portions 32, resin filling ports 52*h* (FIG. 2) are formed on the sides of the outer core portions 32. The resin filling ports 52*h* are in communication with the gaps between the inner peripheral surfaces of the wound portions 2*c* and the outer peripheral surfaces of the inner core portions 31, and the gaps can be filled with resin via the resin filling ports 52*h*.

Molded Resin Portion

In this example, the molded resin portion 4 is a member that integrates the above-described coil 2, the magnetic core 3, and the insulating interposed member 5. In this example, the molded resin portion 4 is formed by inner resin portions 41 (FIG. 2) and outer resin portions 42. Examples of a resin that forms the molded resin portion 4 include a thermoset resin such as epoxy resin, unsaturated polyester resin, urethane resin, and silicone resin, and a thermoplastic resin such as PPS resin, PTFE resin, LCP, PA resin, PI resin, PBT resin, and ABS resin.

As shown in FIG. 2, the inner resin portions 41 are formed by filling the gaps between the wound portions 2*c* and the inner core portions 31 with resin. The inner resin portions 41 join the inner peripheral surfaces of the wound portions 2*c* and the outer peripheral surfaces of the inner core portions 31, and join the end surfaces of the inner core portions 31 and the inner surfaces 32*i* of the outer core portions 32. This inner resin portions 41 are formed in one piece with the later-described outer resin portions 42 via the resin filling ports 52*h*.

As shown in FIGS. 1 and 2, the outer resin portions 42 are formed so as to cover at least the outer surfaces 32*o* of the outer core portions 32 (surfaces on the sides opposite to the inner surfaces 32*i* at which the inner core portions 31 are arranged). In this example, the outer resin portions 42 are formed so as to cover the entireties of the outer peripheral surfaces of the outer core portions 32 that are exposed to the outside when the combined body 10 is assembled, and not only the outer surfaces 32*o*, but also the upper surfaces and lower surfaces of the outer core portions 32 are covered by the outer resin portions 42. The outer resin portions 42 are formed by covering the outer core portions 32 with resin through injection molding.

Terminal Platform

The terminal platform 6 is formed on the outer resin portion 42 on the side in which the end portions of the winding wires 2*w* are arranged. In this example, the terminal platform 6 is formed by a portion of the outer resin portion 42. This terminal platform 6 includes fastening portions (nuts 61) for fastening the terminal fittings 20 and terminals 91 (see FIG. 6) of the later-described bridge members 9 to each other. In this example, two fastening portions are provided on the terminal platform 6 so as to correspond to the terminal fittings 20 connected to the end portions of the winding wires 2*w*.

The terminal fittings 20 are rod-shaped conductors, are connected to the end portions of the winding wires 2*w*, and are routed between the end portions of the winding wires 2*w* and the fastening portions (nuts 61). The terminal fittings 20 include terminal portions 21 that are arranged on the nuts 61 embedded in the terminal platform 6 and are fastened to the terminals 91 (see FIG. 6) of the bridge members 9, and connection portions 22 connected to the end portions of the winding wires 2*w*. The terminal portions 21 are formed into circular ring plate shapes and have through holes through which the bolts are to be inserted. The connection portions 22 are formed into U shapes so as to sandwich the end portions of the winding wires 2*w*, and are connected to the end portions of the winding wires 2*w* through a bonding method such as welding, soldering, or brazing.

The terminal platform 6 further includes a partitioning portion 62 formed by the outer resin portion 42 so as to separate the terminal fittings 20. The partitioning portion 62 increases the creeping distance between the terminal fittings 20 and can increase the electrical strength between the terminal fittings 20. The height of the partitioning portion 62 need only be set as appropriate such that the needed creeping distance can be ensured according to the voltage applied to the coil 2, the usage environment, and the like.

Fixing Portions

In this example, the outer resin portions 42 have fixing portions 43. The fixing portions 43 are for fixing the reactor 1 to the installation target (not shown), and formed by portions of the outer resin portions 42. Collars 43*c* (tube bodies) made of metal are embedded in the fixing portions 43, thus forming through holes through which bolts to be used as fixing tools are inserted. The reactor 1 is fixed to the installation target by inserting the bolts (not shown) into the collars 43*c* of the fixing portions 43 and fastening the bolts in bolt holes provided in the installation target. Commercially-available collars made of metal can be used as the collars 43*c*.

In this example, the left and right sides of the outer resin portions 42 are provided with one fixing portion 43 each. In other words, four fixing portions 43 are included in the entire reactor 1. The number and positions of the fixing portions 43 can be changed as appropriate, and one fixing portion 43 may also be provided on each outer resin portion 42.

Sensor

The sensor 8 is a member for measuring a physical amount that is related to the combined body 10 and that fluctuates during the operation of the reactor 1. The sensor 8 includes a wiring 81 for transmitting detection information (electrical signals) to a control apparatus (not shown) or the like. Examples of a physical amount include temperature and acceleration. In this example, the sensor 8 is a thermistor for measuring the temperature of the coil 2, is held by the sensor holder 80, and is inserted between the pair of wound portions 2*c*.

Wiring Locking Portion

The reactor 1 configured as described above further includes the wiring locking portion 7 for locking the wiring 81 of the sensor 8. The wiring locking portion 7 can be provided on any member that is included in the reactor 1, and in this example, the wiring locking portion 7 is provided on the upper end surface of the partitioning portion 62 of the terminal platform 6 formed by a portion of the outer resin portions 42. Examples of a mounting position other than the partitioning portion 62 include the upper end surface of the end surface interposed member 52. In any case, it is preferable that the wiring 81 is not in contact with the terminal fittings 20. In this manner, it is possible to suppress noise from being superimposed on detection information.

Figure 3:
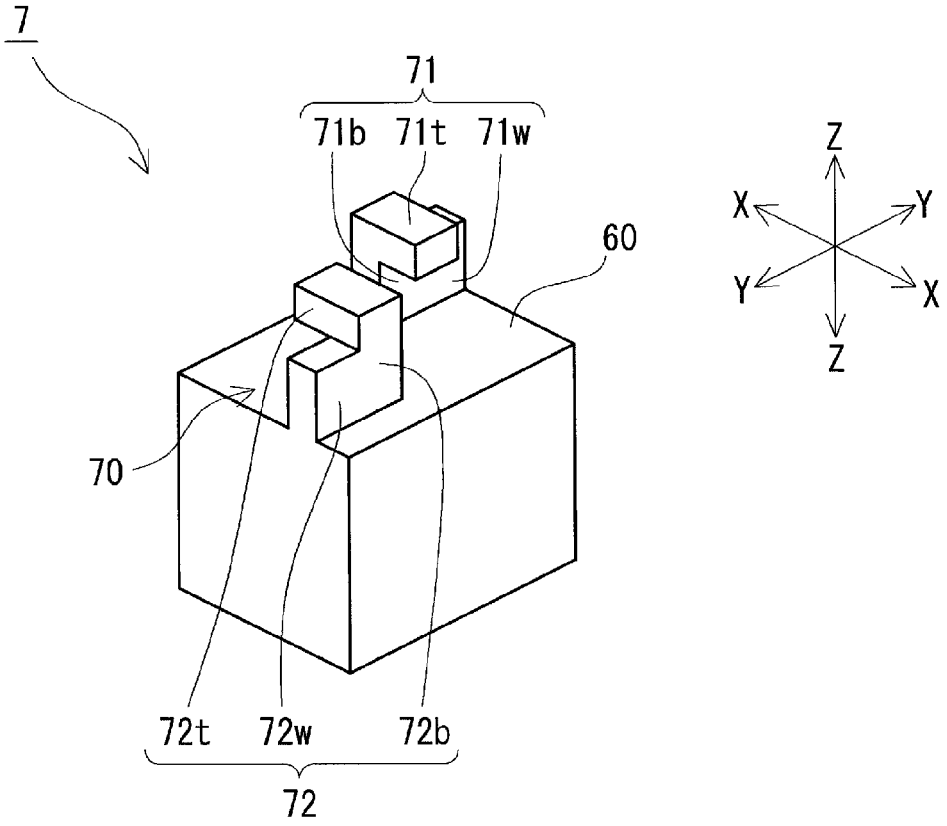
FIG. 3 is a schematic perspective view of a wiring locking portion included in a terminal platform of the reactor according to Embodiment 1.

Next, the configuration of the wiring locking portion 7 will be described with reference to FIGS. 3 to 5. As shown in FIG. 3, the wiring locking portion 7 includes a first claw member 71 and a second claw member 72 that are provided in a standing manner on the upper end surface (flat surface portion 60) of the partitioning portion 62 (FIG. 1). The first claw member 71 is shaped like a claw that is bent at a leading end side thereof, and the second claw member 72 is shaped like a claw that is bent at a leading end side thereof, in a direction opposite to the direction in which the first claw member 71 is bent.

Figure 4:
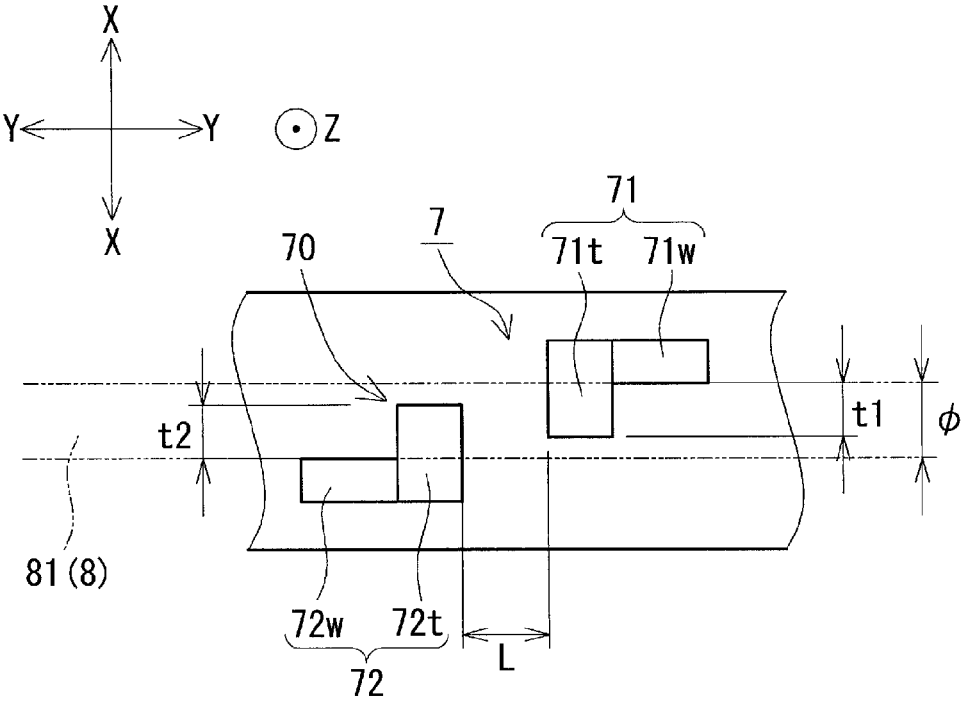
FIG. 4 is a schematic top view of the wiring locking portion shown in FIG. 3.
Figure 5:
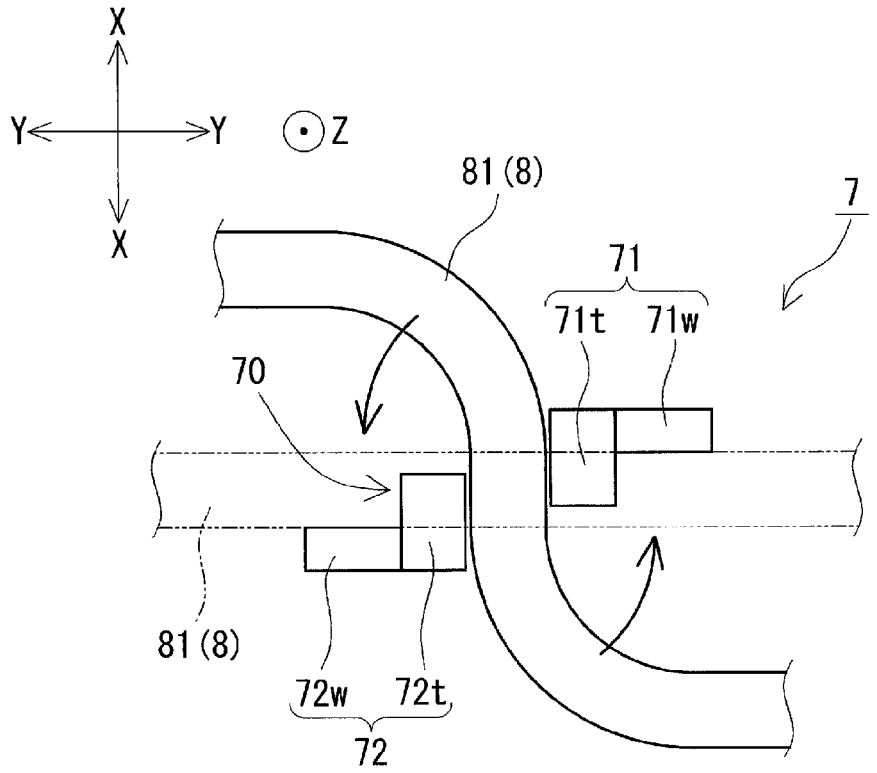
FIG. 5 is a diagram illustrating a method of arranging a wiring of a sensor in the wiring locking portion shown in FIG. 4.

In order to describe the configuration of the claw members 71 and 72 in more detail, a direction along the direction in which the first claw member 71 is bent is denoted as the X direction, the direction perpendicular to the X direction is denoted as the Y direction, and the direction that is vertical to the flat surface portion 60 (direction perpendicular to the X and Y directions) is denoted as the Z direction, as shown in FIGS. 3 to 5.

The first claw member 71 includes a first base portion 71*b*, a first bent end 71*t*, and a first guide wall 71*w*. The first base portion 71*b* is a rectangular member extending in the Z direction. The first bent end 71*t* is a rectangular member extending from the leading end of the first base portion 71*b* toward the second claw member 72 in the X direction. The first guiding wall 71*w* is a rectangular member extending from a side portion of the first base portion 71*b* in the Y direction away from the second claw member 72.

The second claw member 72 includes a second base portion 72*b*, a second bent end 72*t*, and a second guide wall 72*w*. The second base portion 72*b* is a rectangular member extending in the Z direction. The second bent end 72*t* is a rectangular member extending from the leading end of the second base portion 72*b* toward the first claw member 71 in the X direction. The second guide wall 72*w* is a rectangular member extending from a side portion of the second base portion 72*b* in the Y direction away from the first claw member 71. As shown in FIGS. 3 and 4, this second claw member 72 is provided at a position spaced apart from the first claw member 71 in the X and Y directions. Accordingly, a wiring path 70, in which the wiring 81 (FIG. 4) is arranged, is formed inside the bent portions of the claw members 71 and 72. In order to arrange the wiring 81 in the wiring path 70, it is preferable that the separation distance between the lower surfaces of the bent ends 71*t* and 72*t* and the flat surface portion 60 is greater than or equal to the diameter φ of the wiring 81.

The separation distance between the first base portion 71*b* (FIG. 3) of the first claw member 71 and the second base portion 72*b* (FIG. 3) of the second claw member 72 in the X direction may be smaller, larger, or equal to the diameter φ of the wiring. As shown in FIG. 4, if the separation distance is the same as the diameter φ of the wiring 81, the wiring 81 can be arranged straight in the wiring path 70. If the separation distance is smaller than the diameter φ of the wiring 81, the wiring 81 will meander. The range of the separation distance is, for example, preferably at least 0.9 times and at most 1.1 times the diameter φ of the wiring 81, and more preferably, at least 0.95 times and at most 1.05 times the diameter φ.

On the other hand, as shown in FIG. 4, the separation distance L between the first claw member 71 and the second claw member 72 in the Y direction is at least the diameter φ of the wiring 81 and at most 1.5 times the diameter φ. In this manner, the wiring 81 can be easily fitted into the wiring locking portion 7 as described later with reference to FIG. 5. The preferable separation distance L is at least 1.1 times, and at most 1.3 times the diameter φ.

As shown in FIG. 4, when the wiring 81 locked in the wiring locking portion 7 is viewed in the Z direction, the overlap length (in this example, the overlap length of the first bent end 71*t*) of the first claw member 71 that overlaps the upper portion of the wiring 81 is denoted as t1. Similarly, the overlap length (in this example, the overlap length of the second bent end 72*t*) of the second claw member 72 as viewed in the Z direction is denoted as t2. In the wiring locking portion 7 in this example, the sum of the overlap length t1 and the overlap length t2 is greater than or equal to the diameter φ of the wiring 81. With this configuration, even if the wiring shifts in the left-right direction (the X direction), the upper portion of the wiring 81 is held down by the bent ends 71*t* and 72*t*, and thus the wiring 81 hardly comes out of place in the Z direction. Accordingly, even if the reactor 1 (FIG. 1) vibrates intensely, the wiring 81 of the sensor 8 is not likely to come loose from the wiring locking portion 7.

The overlap lengths t1 and t2 are preferably greater than or equal to the radius r (φ/2) of the wiring 81, and less than or equal to the diameter φ of the wiring 81. When the cross-section of the wiring 81 is circular, if the overlap length t1 (t2) of the claw member 71 (72) is short, the portion of the claw member 71 (72) that covers the upper portion of the wiring 81 will not be in contact with the wiring 81. In contrast to this, if the overlap lengths t1 and t2 of the claw members 71 (72) are greater than or equal to the radius r of the wiring 81, the portions of the claw members 71 (72) that cover the upper portion of the wiring 81 will reliably be in contact with the wiring 81, and thus shifting of the wiring 81 can be easily suppressed.

In addition, since the claw member 71 (72) is provided with the guide wall 71*w* (72*w*), the direction of the wiring 81 that is fitted into the claw member 71 (72) is easily regulated. In this example, since the guide wall 71*w* (72*w*) extends straight in the Y direction, the wiring 81 that is locked in the wiring locking portion 7 also can be stretched straight in the Y direction. In addition, the wiring 81 can be guided in the direction in which the guide wall 71*w* (72*w*) is bent by bending the far end (end portion that is located away from the base portion 71*b* (72*b*)) of the guide wall 71*w* (72*w*).

Next, the method for locking the wiring 81 in the wiring locking portion 7 configured as above will be described with reference to FIG. 5. When fitting the wiring 81 into the claw members 71 and 72, the wiring 81 (see the solid line) is fitted into the separation space between the claw members 71 and 72 in the Y direction. A portion of the wiring 81 that is fitted into the separation space substantially extends along the X direction. Thereafter, the wiring 81 can be easily fitted into the claw members 71 and 72 by pulling both end sides of the wiring 81, rotating the portion fitted into the separation space as indicated by the bold arrows, or the like, so as to stretch the portion straight along the Y direction. When fitting the wiring 81, since the portion that opposes the claw member 71 (72) in the X direction has no protrusion such as a wall, the wiring 81 (see the two-dot chain line) can be fitted into the wiring path 70 of the wiring locking portion 7 by rotating the wiring 81 in the directions indicated by the bold arrows.

Bridge Member

Figure 6:
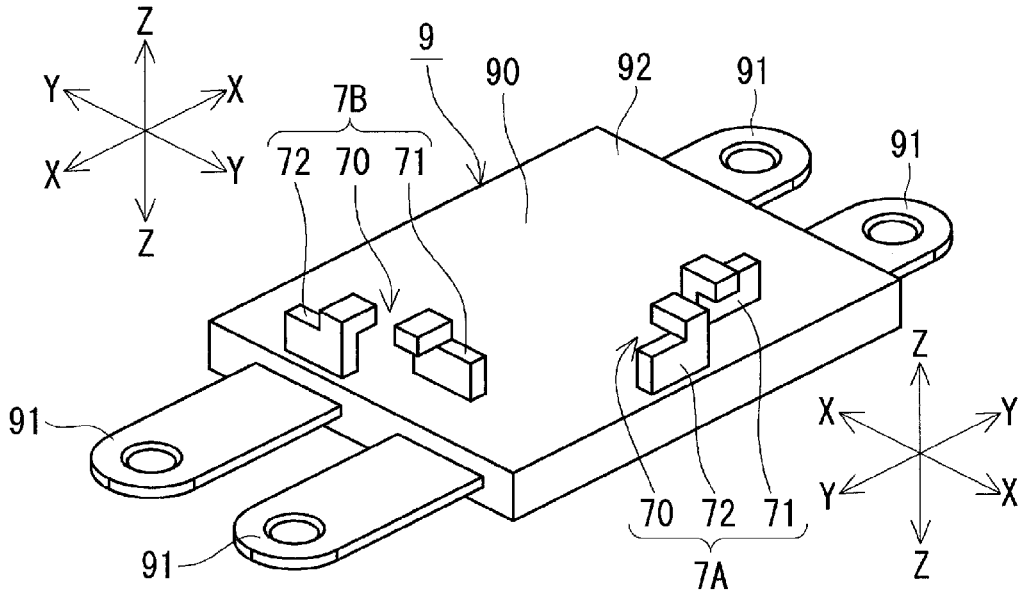
FIG. 6 is a schematic perspective view of a wiring locking portion included in a bridge member of the reactor according to Embodiment 1.

As shown in FIG. 1, there are cases in which the reactor 1 is connected to a bus bar in an external power source (not shown) via the terminal platform 6 and the bridge member 9 shown in FIG. 6. In this case, the bridge member 9 is considered as a constitutional element of the reactor 1.

The bridge member 9 in FIG. 6 is formed by integrating the two terminals 91 with a terminal mold portion 92. The end portion of the terminal 91 on the rear-right side in FIG. 6 is connected to the terminal portion 21 on the rear-left side in FIG. 1, and the end portion of the terminal 91 on the front-right side in FIG. 6 is connected to the terminal portion 21 on the front-left side in FIG. 1. Screws can be used to connect them. The partitioning portion 62 shown in FIG. 1 is interposed between the two terminals 91 that are respectively connected to the two terminal portions 21, thereby suppressing the occurrence of a short circuit between the terminals 91. The end portions of the terminals 91 on the left side in FIG. 6 are connected to a bus bar (not shown). Screws can also be used to connect them.

The above-described bridge member 9 includes two wiring locking portions 7 on the upper surface (flat plate portion 90) of the terminal mold portion 92. The shape and size of the wiring locking portions 7 are the same as the wiring locking portion 7 described with reference to FIGS. 3 and 4. Note that the wiring locking portion 7A on the right side in the figure is provided such that the wiring path 70 extends along the direction in which the terminals 91 extend, and the wiring locking portion 7B on the left side in the figure is provided such that the wiring path 70 extends along the parallel direction of the terminals 91. In other words, one wiring path 70 and the other wiring path 70 are arranged perpendicular (non-coaxial) to each other.

By using the two wiring locking portions 7A and 7B in FIG. 6, the direction of the wiring 81 guided from the terminal platform 6 (FIG. 1) by the wiring locking portion 7 shown in FIGS. 3 and 4 can be changed. Specifically, the wiring 81 extending from the terminal platform 6 side is fitted into the wiring locking portion 7A on the right in FIG. 6, and is fitted into the wiring locking portion 7B on the left as well. By doing so, the end portion of the wiring 81 on the side opposite to the reactor 1 can be guided from the position of the wiring locking portion 7B to the outer side in the parallel direction of the terminals 91, and the wiring 81 can also be suppressed from moving intensely in accordance with the vibration of the reactor 1.

The wiring 81 can be guided in the desired direction by changing the wiring paths 70 of the plurality of wiring locking portions 7A and 7B.

Embodiment 2

Although the claw members 71 and 72 are substantially L-shaped in a view in the Y direction as shown in FIG. 3 and the like in Embodiment 1, the shapes of the claw members 71 and 72 are not limited thereto. The claw members 71 and 72 may be shaped as shown in FIG. 7, for example, as long as the leading end portions of the claw members 71 and 72 are bent and cover the upper portion of the wiring 81.

Figure 7:
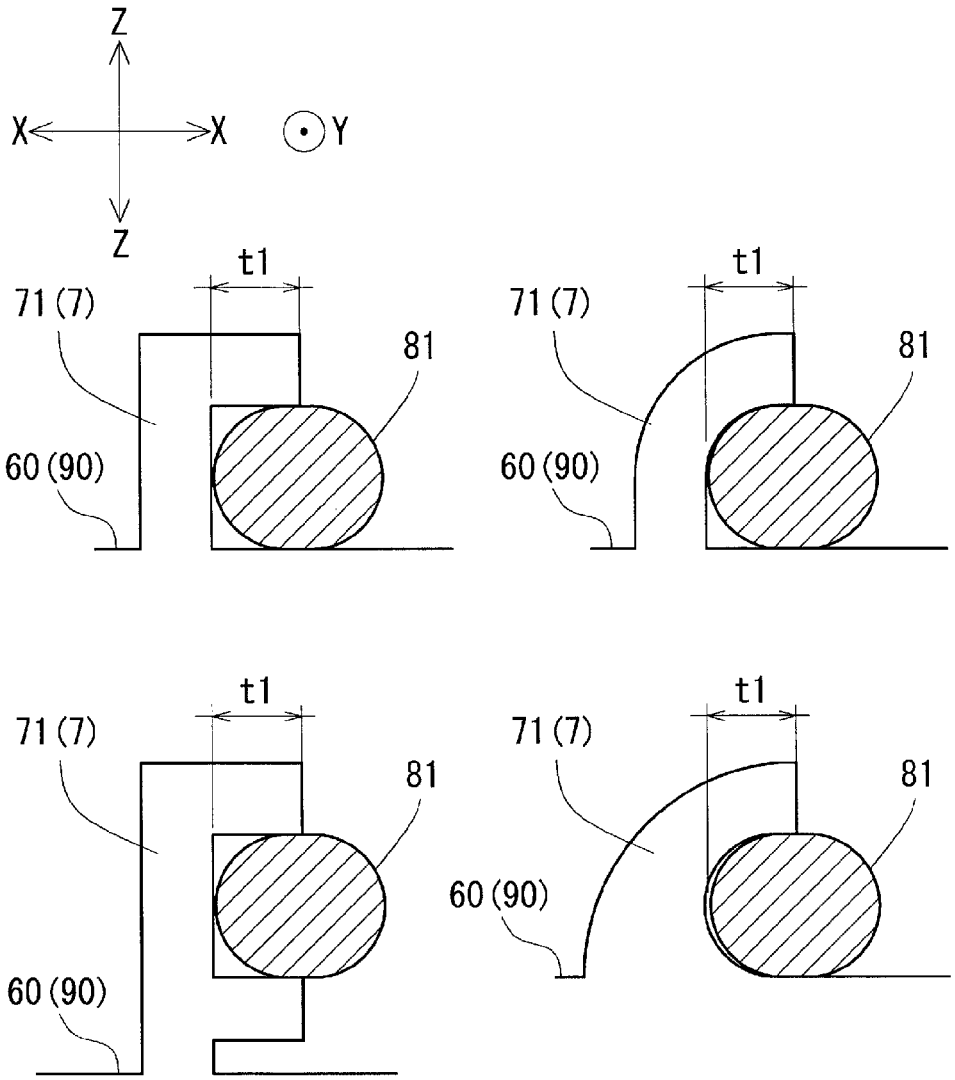
FIG. 7 is a schematic cross-sectional view showing variations of a wiring locking portion illustrated in Embodiment 2.

FIG. 7 is a diagram showing a positional relationship between the wiring 81 and the first claw member 71 as viewed in the Y direction. The second claw member 72 is not shown in FIG. 7. The top-left figure in FIG. 7 shows the substantially L-shaped first claw member 71 that was described in Embodiment 1. As shown in the bottom-left in FIG. 7, the first claw member 71 can also be substantially F-shaped. In addition, as shown in the top-right in FIG. 7, the first claw member 71 can also be formed by a linear portion extending in the Z direction and a portion substantially shaped in a ¼ arc that is formed at the leading end thereof. Alternatively, as shown in the bottom-right in FIG. 7, the first claw member 71 can also be shaped like a wave in which the inner peripheral surface on the wiring 81 side of the first claw member 71 is formed in a half arc along the outline of the wiring 81.

APPLICATION

The reactor 1 in the above-described embodiments can be applied to power conversion devices of electric vehicles such as hybrid cars.

The invention claimed is:

1. A reactor comprising:

a coil that has wound portions formed by winding a winding wire;

a magnetic core that includes inner core portions arranged inside of the wound portions and outer core portions arranged outside of the wound portions;

a sensor configured to measure a physical amount that is related to a combined body of the coil and the magnetic core and that changes in accordance with energization of the coil; and a wiring locking portion configured to lock a wiring of the sensor, wherein the wiring locking portion includes:

a first claw member that is provided in a standing manner on a flat surface portion of any member included in the reactor and that is bent at a leading end side thereof, a second claw member that is provided in a standing manner on the flat surface portion and that is bent at a leading end side thereof, in a direction that is opposite to the direction in which the first claw member is bent; and a wiring path that is formed inside the bent portions of the claw members, and in which the wiring is arranged, and when, among directions along the flat surface portion, a direction along the direction in which the first claw member is bent is denoted as an X direction, a direction perpendicular to the X direction is denoted as a Y direction, and a vertical direction with respect to the flat surface portion is denoted as a Z direction, the second claw member is provided at a position spaced apart from the first claw member in the X direction and the Y direction, a separation distance L between the leading end of the first claw member and the leading end of the second claw member in the Y direction is greater than 1 times the diameter of the wiring and less than or equal to 1.5 times the diameter of the wiring, and when the wiring that is locked in the wiring locking portion is viewed in the Z direction, the sum of an overlap length t1 of a portion of the first claw member that overlaps an upper portion of the wiring and an overlap length t2 of a portion of the second claw member that overlaps an upper portion of the wiring is greater than or equal to the diameter of the wiring.

2. The reactor according to claim 1, wherein the overlap length t1 of the first claw member and the overlap length t2 of the second claw member are greater than or equal to the radius of the wiring and less than or equal to the diameter of the wiring.

3. The reactor according to claim 2, wherein the first claw member includes a first base portion that extends in the Z direction and a first bent end that extends from the leading end of the first base portion toward the second claw member in the X direction, and the second claw member includes a second base portion that extends in the Z direction and a second bent end that extends from the leading end of the second base portion toward the first claw member in the X direction.

4. The reactor according to claim 2, further comprising a plurality of the wiring locking portions, wherein the wiring path of one of the wiring locking portions and the wiring path of another of the wiring locking portions are non-coaxial to each other.

5. The reactor according to claim 2, further comprising:

terminal fittings that are connected to end portions of the winding wire;

a bridge member that electrically connects the terminal fittings to an external wiring; and a terminal platform that serves as a platform for fastening the terminal fittings to the bridge member, wherein the wiring locking portion is formed on the terminal platform.

6. The reactor according to claim 1, wherein the first claw member includes a first base portion that extends in the Z direction and a first bent end that extends from the leading end of the first base portion toward the second claw member in the X direction, and the second claw member includes a second base portion that extends in the Z direction and a second bent end that extends from the leading end of the second base portion toward the first claw member in the X direction.

7. The reactor according to claim 6, wherein the first claw member includes a first guide wall that extends from a side portion of the first base portion, in a direction away from the second claw member in the Y direction, and the second claw member includes a second guide wall that extends from a side portion of the second base portion, in a direction away from the first claw member in the Y direction.

8. The reactor according to claim 7, further comprising a plurality of the wiring locking portions, wherein the wiring path of one of the wiring locking portions and the wiring path of another of the wiring locking portions are non-coaxial to each other.

9. The reactor according to claim 7, further comprising:

terminal fittings that are connected to end portions of the winding wire;

a bridge member that electrically connects the terminal fittings to an external wiring; and a terminal platform that serves as a platform for fastening the terminal fittings to the bridge member, wherein the wiring locking portion is formed on the terminal platform.

10. The reactor according to claim 6, further comprising a plurality of the wiring locking portions, wherein the wiring path of one of the wiring locking portions and the wiring path of another of the wiring locking portions are non-coaxial to each other.

11. The reactor according to claim 6, further comprising:

terminal fittings that are connected to end portions of the winding wire;

a bridge member that electrically connects the terminal fittings to an external wiring; and a terminal platform that serves as a platform for fastening the terminal fittings to the bridge member, wherein the wiring locking portion is formed on the terminal platform.

12. The reactor according to claim 1, further comprising a plurality of the wiring locking portions, wherein the wiring path of one of the wiring locking portions and the wiring path of another of the wiring locking portions are non-coaxial to each other.

13. The reactor according to claim 12, further comprising:

terminal fittings that are connected to end portions of the winding wire;

a bridge member that electrically connects the terminal fittings to an external wiring; and a terminal platform that serves as a platform for fastening the terminal fittings to the bridge member, wherein the wiring locking portion is formed on the terminal platform.

14. The reactor according to claim 1, further comprising:

terminal fittings that are connected to end portions of the winding wire;

a bridge member that electrically connects the terminal fittings to an external wiring; and a terminal platform that serves as a platform for fastening the terminal fittings to the bridge member, wherein the wiring locking portion is formed on the terminal platform.

15. The reactor according to claim 14, wherein the wiring locking portion is formed on the bridge member.

16. The reactor according to claim 14, comprising an outer resin portion that covers at least an outer surface of the outer core portions, wherein the terminal platform is formed by a portion of the outer resin portion.

* * * * *